US010759196B2

(12) United States Patent
Nakano et al.

(10) Patent No.: US 10,759,196 B2
(45) Date of Patent: Sep. 1, 2020

(54) RECORDING DEVICE

(71) Applicant: SEIKO EPSON CORPORATION, Tokyo (JP)

(72) Inventors: Shuichiro Nakano, Matsumoto (JP); Tomohiro Yoda, Matsumoto (JP); Katsuya Asamoto, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/361,857

(22) Filed: Mar. 22, 2019

(65) Prior Publication Data

US 2019/0291472 A1 Sep. 26, 2019

(30) Foreign Application Priority Data

Mar. 23, 2018 (JP) ..... 2018-055765

(51) Int. Cl.
*B41J 11/00* (2006.01)
*B41J 2/165* (2006.01)
*B41J 2/17* (2006.01)

(52) U.S. Cl.
CPC ..... *B41J 11/002* (2013.01); *B41J 2/16535* (2013.01); *B41J 2/1721* (2013.01); *B41J 11/0085* (2013.01)

(58) Field of Classification Search
CPC ..... B41J 2/16535; B41J 2/1721; B41J 2/01; B41J 11/002; B41J 15/16
USPC ..... 347/101, 102, 104
See application file for complete search history.

(56) References Cited

U.S. PATENT DOCUMENTS 9,211,729 B2 * 12/2015 Sasaki ..... B41J 11/06
9,446,613 B2 * 9/2016 Nakano ..... B41J 15/16
9,855,740 B2 * 1/2018 Nakano ..... B41J 13/0009

FOREIGN PATENT DOCUMENTS

JP 2006-095976 A 4/2006

* cited by examiner

*Primary Examiner* — An H Do
(74) *Attorney, Agent, or Firm* — Foley & Lardner LLP

(57) ABSTRACT

A recording device includes a carriage including a recording head configured to discharge liquid onto a medium and being movable in an intersecting direction, the intersecting direction intersecting a transport direction of the medium, a suction platen facing the recording head and being configured to suck the medium, a transport mechanism provided upstream from the suction platen in the transport direction and configured to transport the medium downstream in the transport direction, a drying unit located downstream from the recording head in the transport direction, a medium suction mechanism configured to suck the medium fed to the drying unit, and a controller configured to control the transport mechanism. The controller is configured to form a curved portion by curving between the drying unit and the suction platen in the transport direction, a part of the medium.

9 Claims, 9 Drawing Sheets

RECORDING DEVICE

BACKGROUND

The invention relates to a recording device that performs recording on a medium.

Some known ink jet printers as one type of recording devices include a paper transport device that transports roll paper as one type of media. For example, when recording having a high printing ratio (duty) is performed on roll paper in an ink jet printer, many ink particles are discharged onto the roll paper. A so-called cockle caused by the roll paper absorbing a large amount of ink and swelling in a wave shape may be generated in the roll paper to which many ink particles are adhering.

A recording device including ribs provided on a platen facing a recording head is used for solving a malfunction that a cockle is generated (JP-A-2006-95976). The printer described in JP-A-2006-95976 is configured in such a way that a cockle can escape between the ribs, and a cockle generated in a medium by a suction hole provided between the ribs can be reliably sucked to the ribs and a formation surface of the ribs.

SUMMARY

Some ink jet printers include a drying unit that dries a medium on which recording is executed and is located downstream from a recording head in a transport direction of a medium. When roll paper that has absorbed a large amount of ink is dried by this drying unit, a dry wrinkle generated in the drying unit may extend upstream in the transport direction and reach the platen. In this case, there is a risk that roll paper may not be completely adhered to the platen by the suction hole due to the large dry wrinkle even with the platen described in JP-A-2006-95976. Then, there is a risk that the medium may lifts up from the platen due to the dry wrinkle reaching the platen, and the roll paper lifting up from the platen may collide with the recording head moving in a direction intersecting the transport direction of the roll paper.

One advantage of certain embodiments is to provide a recording device capable of reducing contact between a medium in which a dry wrinkle arises and a recording head.

To solve the problem above, according to one embodiment, a recording device includes a carriage including a recording head configured to discharge liquid onto a medium and being movable in an intersecting direction, the intersecting direction intersecting a transport direction, a suction platen facing the recording head and being configured to suck the medium, a transport mechanism provided upstream from the suction platen in the transport direction of the medium and configured to transport the medium downstream in the transport direction, a drying unit located downstream from the recording head in the transport direction, a medium suction mechanism configured to suck the medium fed to the drying unit, and a controller configured to control the transport mechanism. In the recording device, the controller is configured to form a curved portion by curving, between the drying unit and the suction platen in the transport direction, a part of the medium.

In the above embodiment, the curved portion can be formed by curving a part of the medium, between the drying unit and the suction platen in the transport direction. For example, when a dry wrinkle arising in the drying unit extends, in the medium, upstream in the transport direction, the curved portion can prevent the dry wrinkle from extending, in the medium, to the suction platen. As a result, the medium on the suction platen can be less likely to lift up from the suction platen, and contact between the medium on the suction platen and the recording head can be suppressed.

In a recording device according to another embodiment, when a maintenance operation of the recording head is executed while a part of the medium is located in the drying unit, the controller is configured to move the carriage in the intersecting direction for the maintenance operation, after the curved portion has been formed. And the curved portion is formed by feeding the medium by a predetermined amount by the transport mechanism while the medium is sucked by the medium suction mechanism and sucking the medium by the suction platen after the medium fed by the predetermined amount.

In the above embodiment, when the maintenance operation of the recording head is executed while a part of the medium is located in the drying unit, moving the carriage before the maintenance operation is executed after the curved portion has been formed. Therefore, when the curved portion is formed, that is, when the medium on the suction platen is less likely to be lifted up from the platen, the carriage moves in the intersecting direction and then the maintenance operation is executed. Thus, contact between the medium on the suction platen and the recording head during the movement operation can be more reliably suppressed.

A recording device according to another embodiment further includes a discharge mechanism provided downstream from the suction platen in the transport direction and configured to discharge the medium. In the recording device, the controller, after the execution of the maintenance operation, is configured to eliminate the curved portion by stopping sucking the medium by the suction platen and the medium suction mechanism, and feeding the medium downstream in the transport direction by the discharge mechanism after stopping sucking.

In the above embodiment, contact between the medium on the suction platen and the recording head can be suppressed by forming the curved portion. Thus, smudging the medium on the suction platen due to contact with the recording head can be suppressed. As a result, the recording operation can restart from the portion of the medium located on the suction platen only by eliminating the curved portion from the medium. Thus, a portion of the medium without execution of recording between a portion on which recording has already been executed (portion located in the drying unit) and a portion on which recording is to be newly executed can be reduced in length, so that waste paper in the medium can be reduced.

In a recording device according to another embodiment, the controller, after the maintenance operation, is configured to eliminate the curved portion by stopping sucking the medium the suction platen, and feeding the medium upstream in the transport direction by the transport mechanism after stopping sucking.

In the above embodiment, the portion of the medium in which the curved portion is formed is wound back to the suction platen, and recording can be executed by the recording head. Thus, a gap between the recorded portions of the medium in the transport direction can be reduced, and the amount of waste paper in the medium can be reduced.

A recording device according to another embodiment further includes a maintenance mechanism configured to perform maintenance on the recording head. In the recording device, one side of a region of movement of the carriage in the intersecting direction is a home position, and the maintenance mechanism is disposed on the other side.

In the above embodiment, the recording device can achieve an effect similar to that in any of the other embodiments described above.

In a recording device according to another embodiment, the maintenance operation is executed after the carriage have been moved from the one side to the other side in the intersecting direction.

In the above embodiment, at this time, the carriage moves to the other side while the curved portion is formed. Thus, contact between the recording head and the medium on the suction platen can be more reliably reduced.

In a recording device according to according to another embodiment, the maintenance mechanism includes a waste liquid receiving portion configured to receive liquid discharged from the recording head during the maintenance operation and a wiper configured to clean a nozzle surface of the recording head.

In the above embodiment, the recording device can achieve an effect similar to that in any of the other embodiments described above.

A recording device according to another embodiment further includes a discharge mechanism provided downstream from the suction platen in the transport direction and configured to discharge the medium. In the recording device, the curved portion is formed by adjusting at least one of a medium feeding speed of the transport mechanism and a medium feeding speed of the discharge mechanism.

In the above embodiment, the curved portion is formed by adjusting at least one of the medium feeding speed of the transport mechanism and the medium feeding speed of the discharge mechanism, and thus the size of the curved portion to be formed can be adjusted as appropriate. As a result, the curved portion having the appropriate size according to a kind of the medium is formed, and thus a dry wrinkle extending from the drying unit can be more reliably prevented by the curved portion.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Exemplary embodiments will be described with reference to drawings. Note that, the same configuration has the same reference sign in each of the exemplary embodiments and is described only in the first exemplary embodiment, and description of the configuration is omitted in the following exemplary embodiment.

Figure 1:
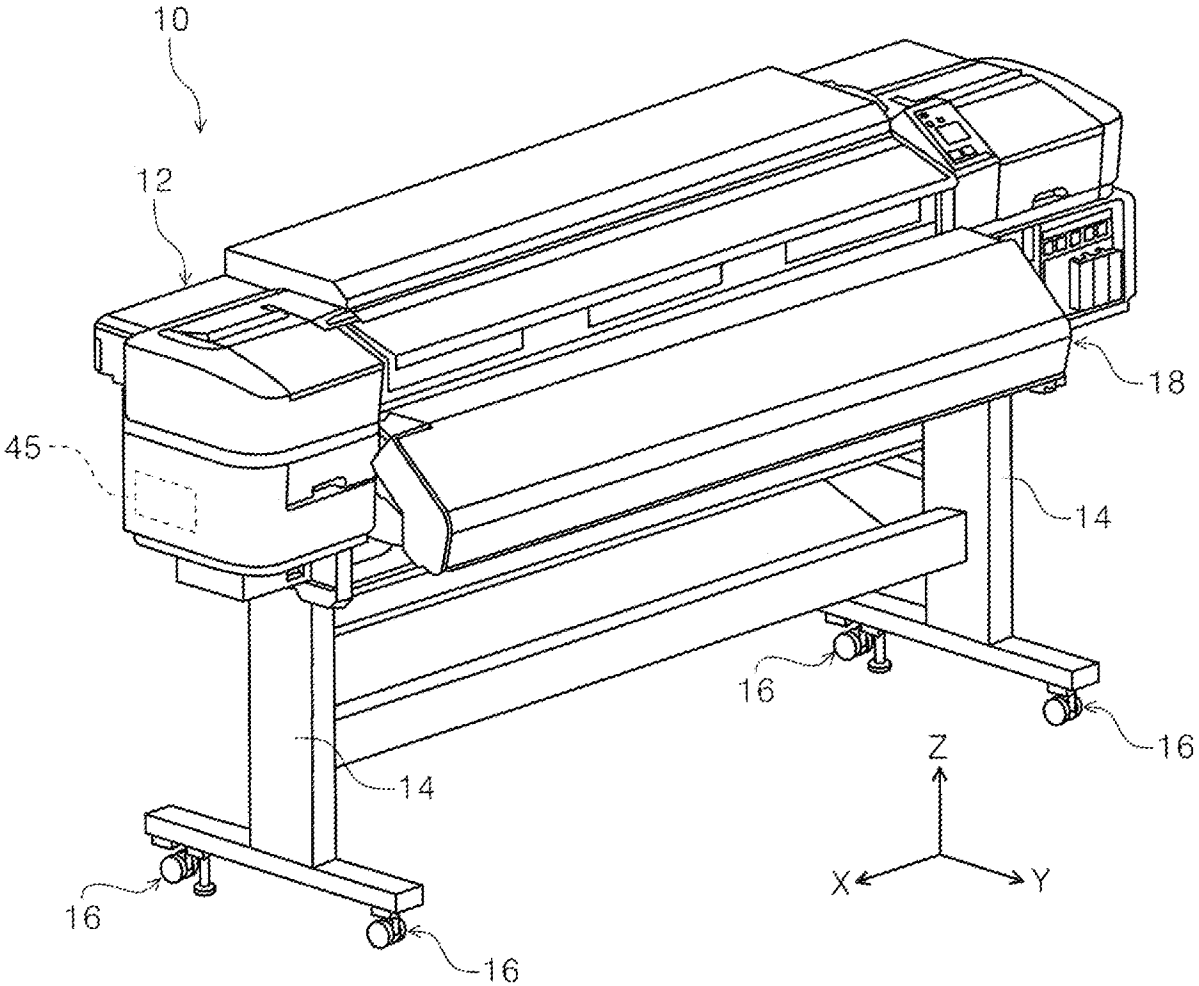
FIG. 1 is a perspective view of an external appearance of a printer in the disclosure.
Figure 2:
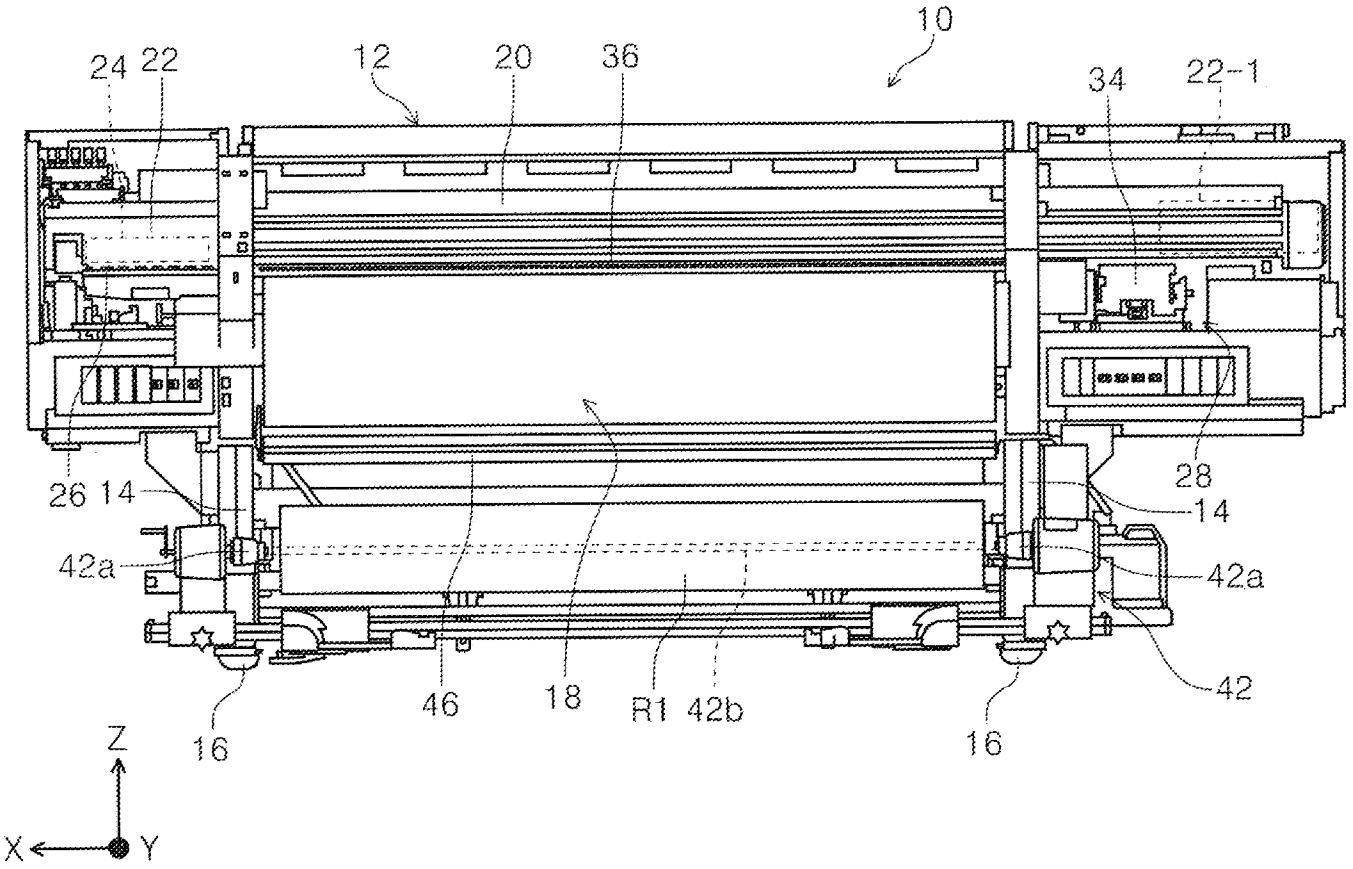
FIG. 2 is a front view of the printer in the disclosure.
Figure 3:
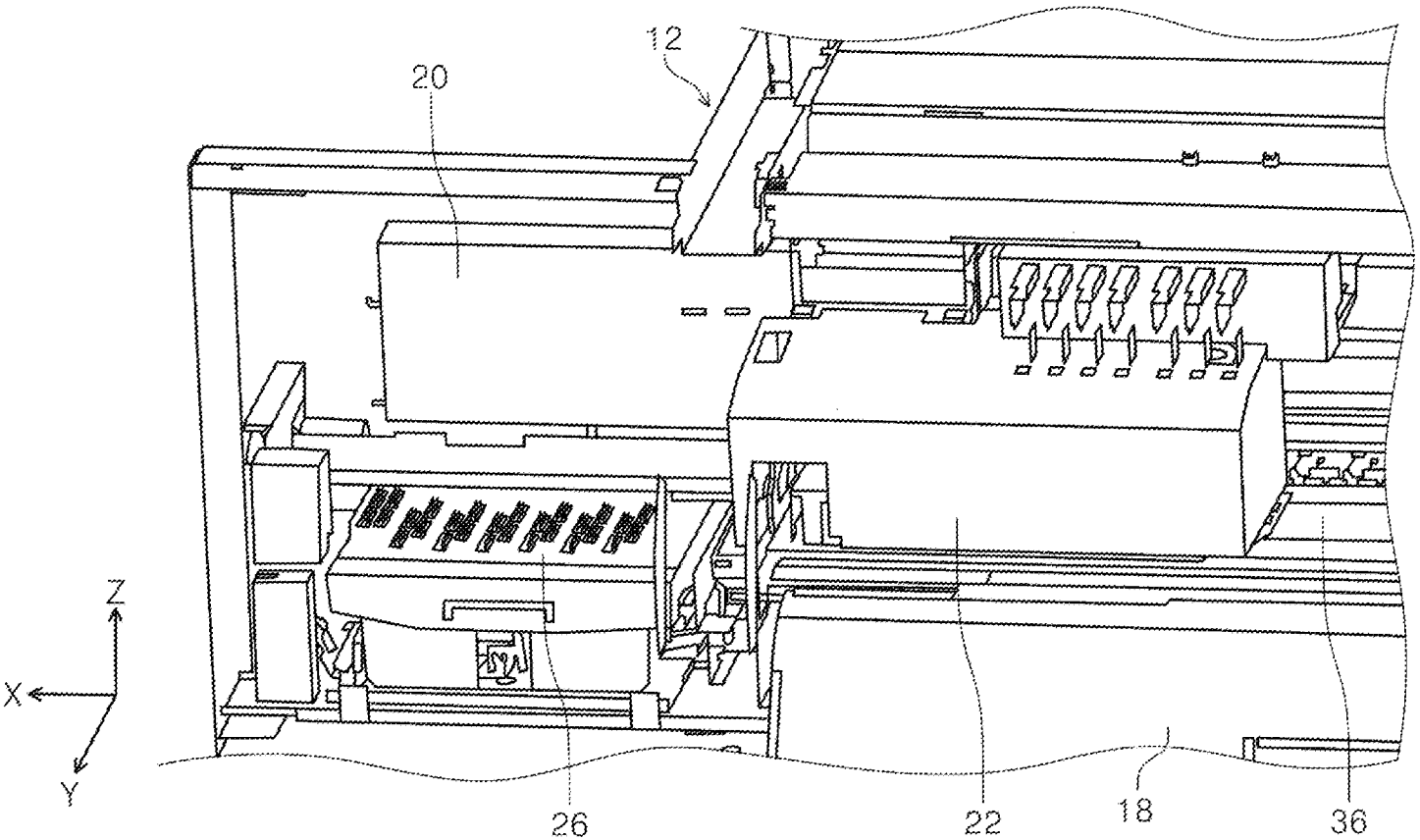
FIG. 3 is a perspective view illustrating a home position side of a carriage in the printer.
Figure 4:
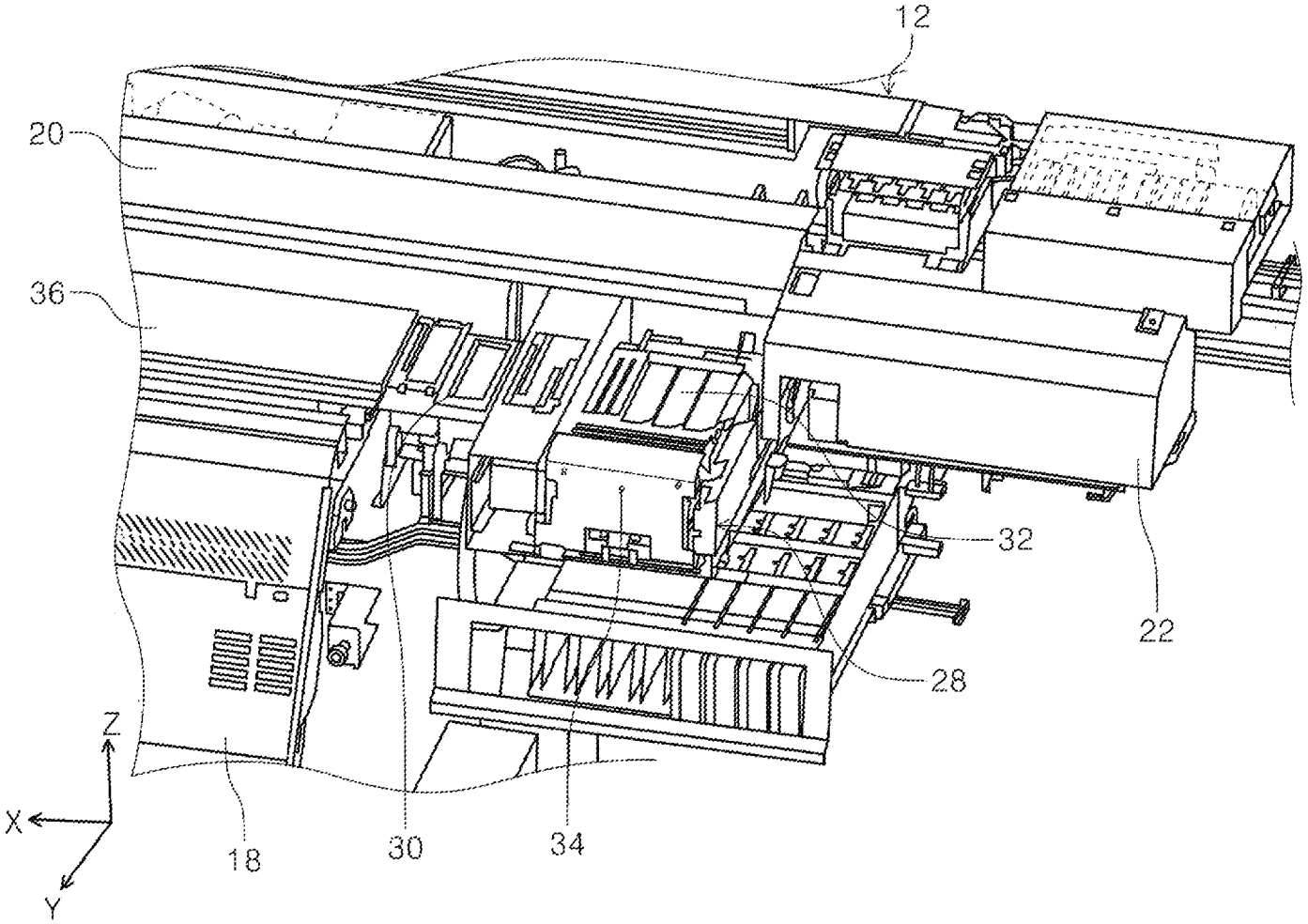
FIG. 4 is a perspective view illustrating a maintenance mechanism in the printer.

FIG. 1 is a perspective view of an external appearance of a printer. FIG. 2 is a front view of the printer. FIG. 3 is a perspective view illustrating a home position side of a carriage in the printer. FIG. 4 is a perspective view illustrating a maintenance mechanism in the printer.

Figure 5:
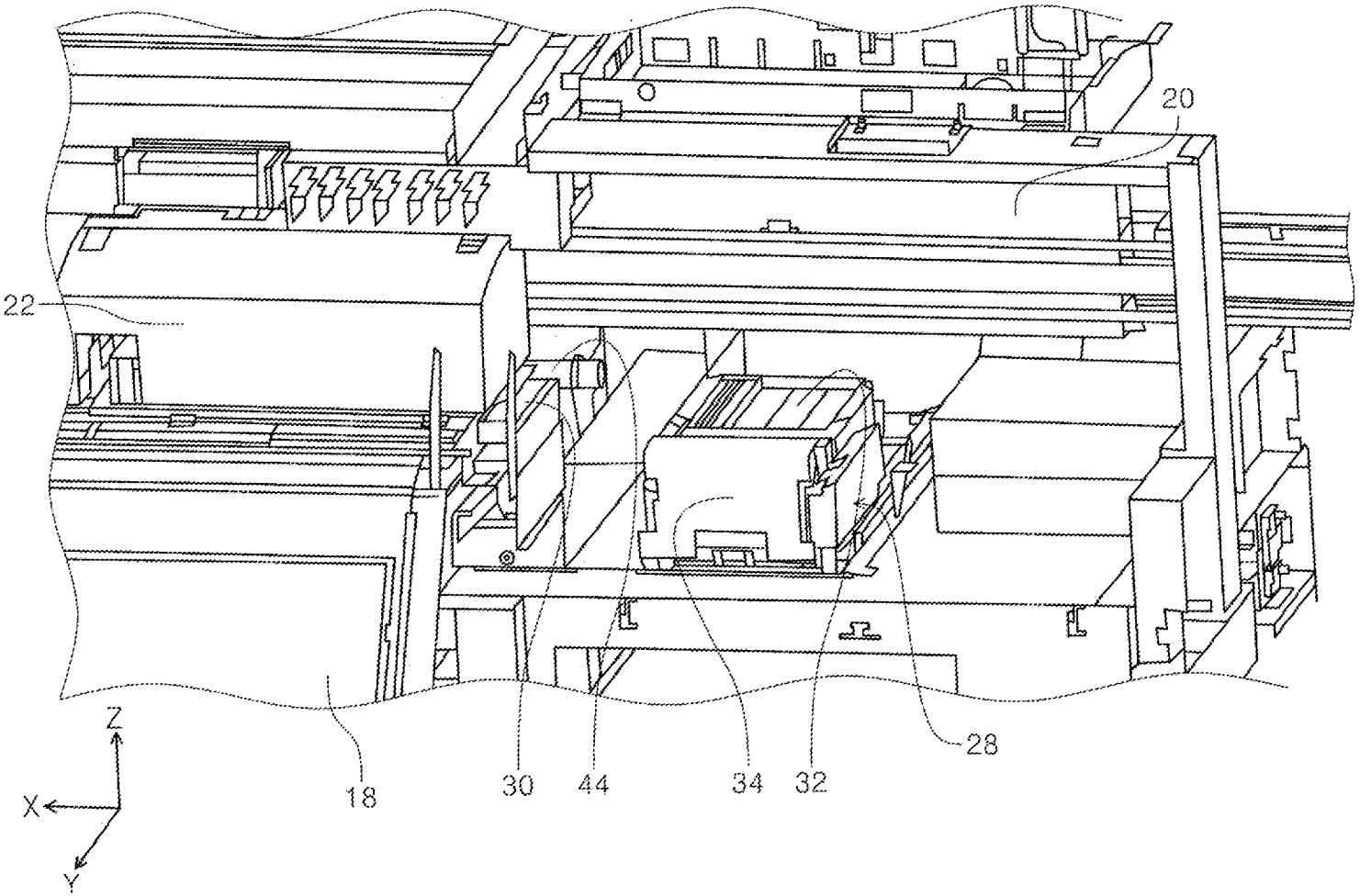
FIG. 5 is a perspective view illustrating a state where the carriage is located above a suction platen during a maintenance operation.
Figure 6:
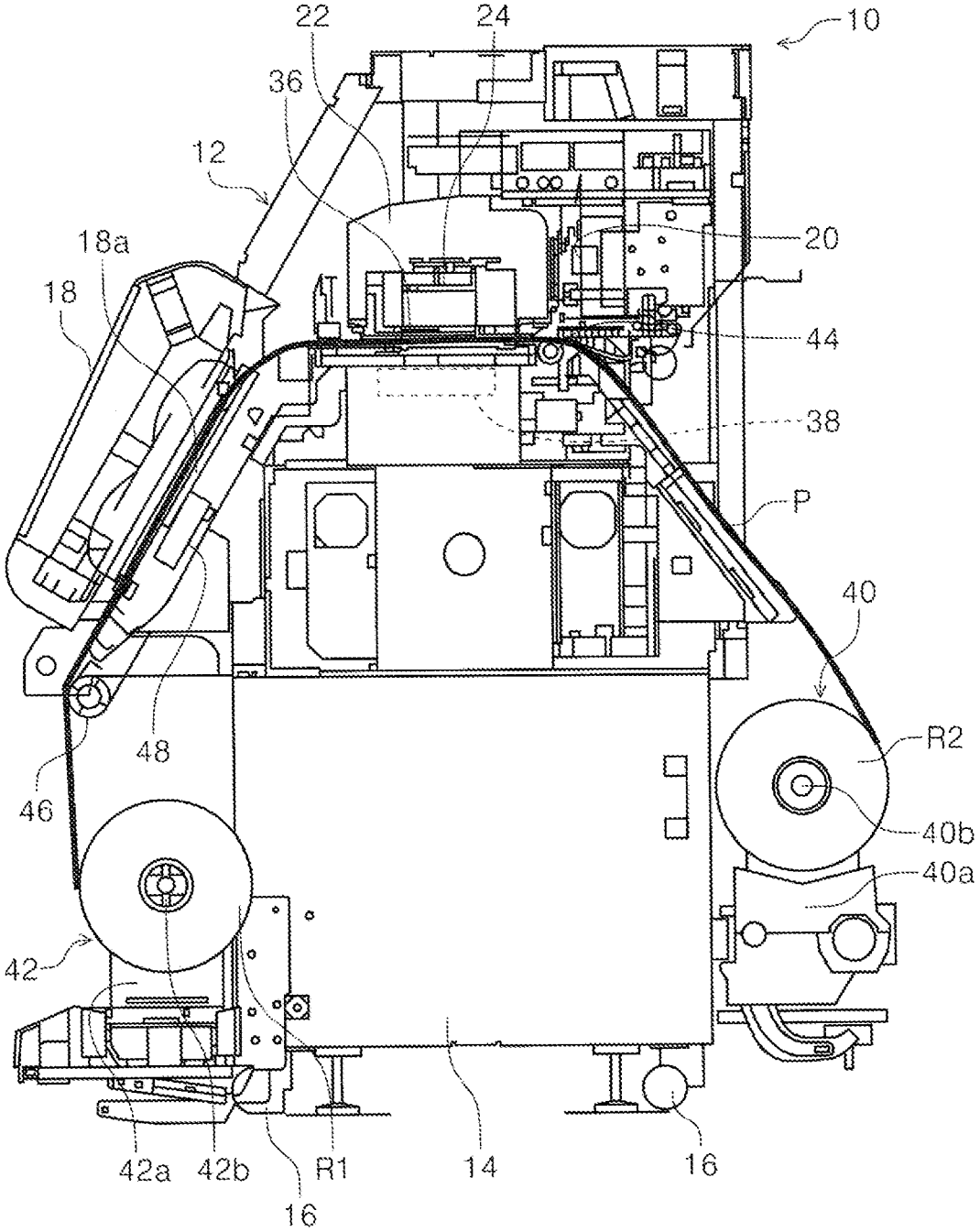
FIG. 6 is a side cross-sectional view illustrating a medium transport path of the printer in the disclosure.
Figure 7:
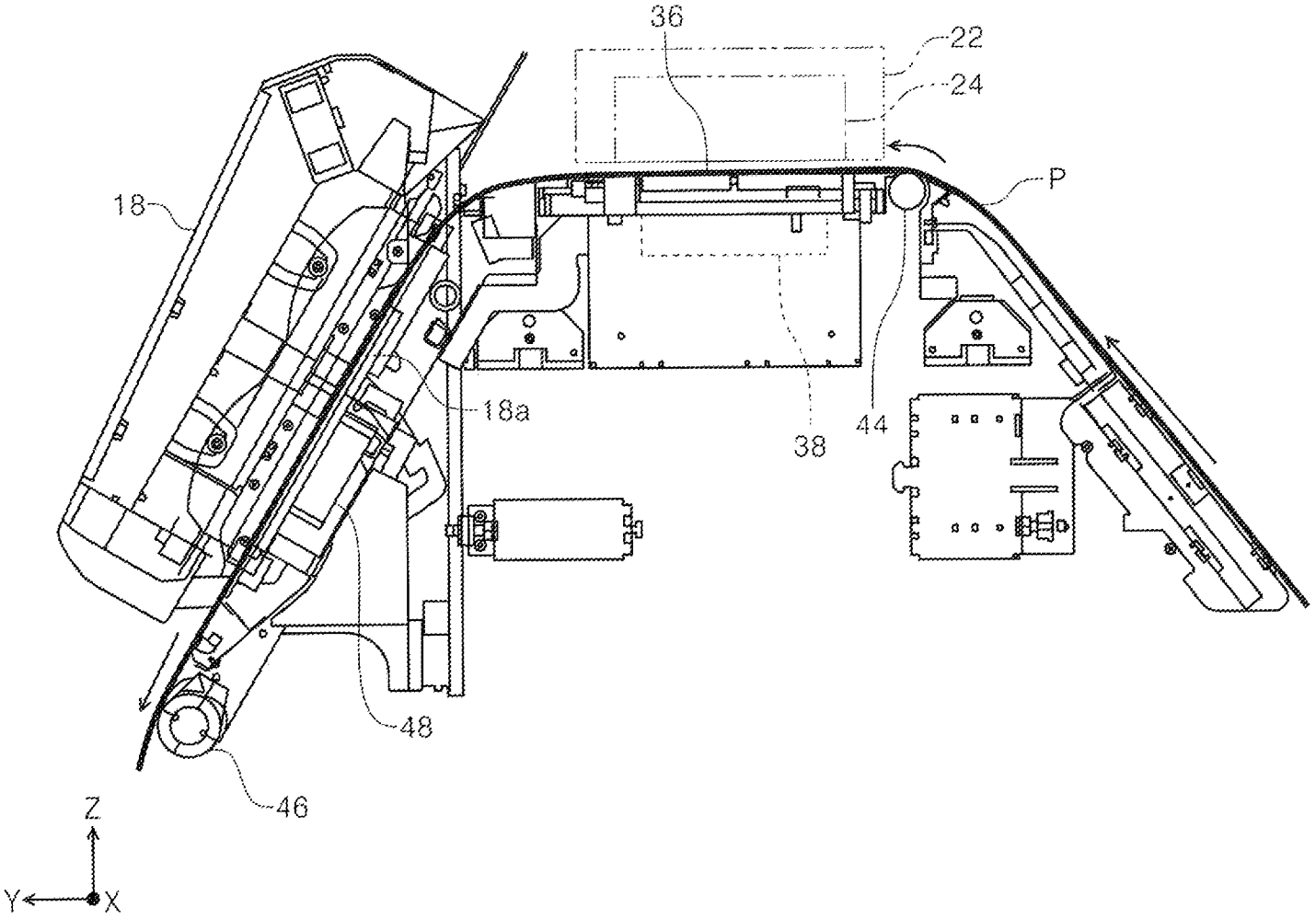
FIG. 7 is a side cross-sectional view illustrating a state where a medium is transported by a transport mechanism and a discharge mechanism in the medium transport path of the printer.

FIG. 5 is a perspective view illustrating a state where the carriage is located above a suction platen during a maintenance operation. FIG. 6 is a side cross-sectional view illustrating a medium transport path of the printer. FIG. 7 is a side cross-sectional view illustrating a state where a medium is transported by a transport mechanism and a discharge mechanism in the medium transport path of the printer. In this disclosure, a medium transport direction is a direction along the medium transport path.

Figure 8:
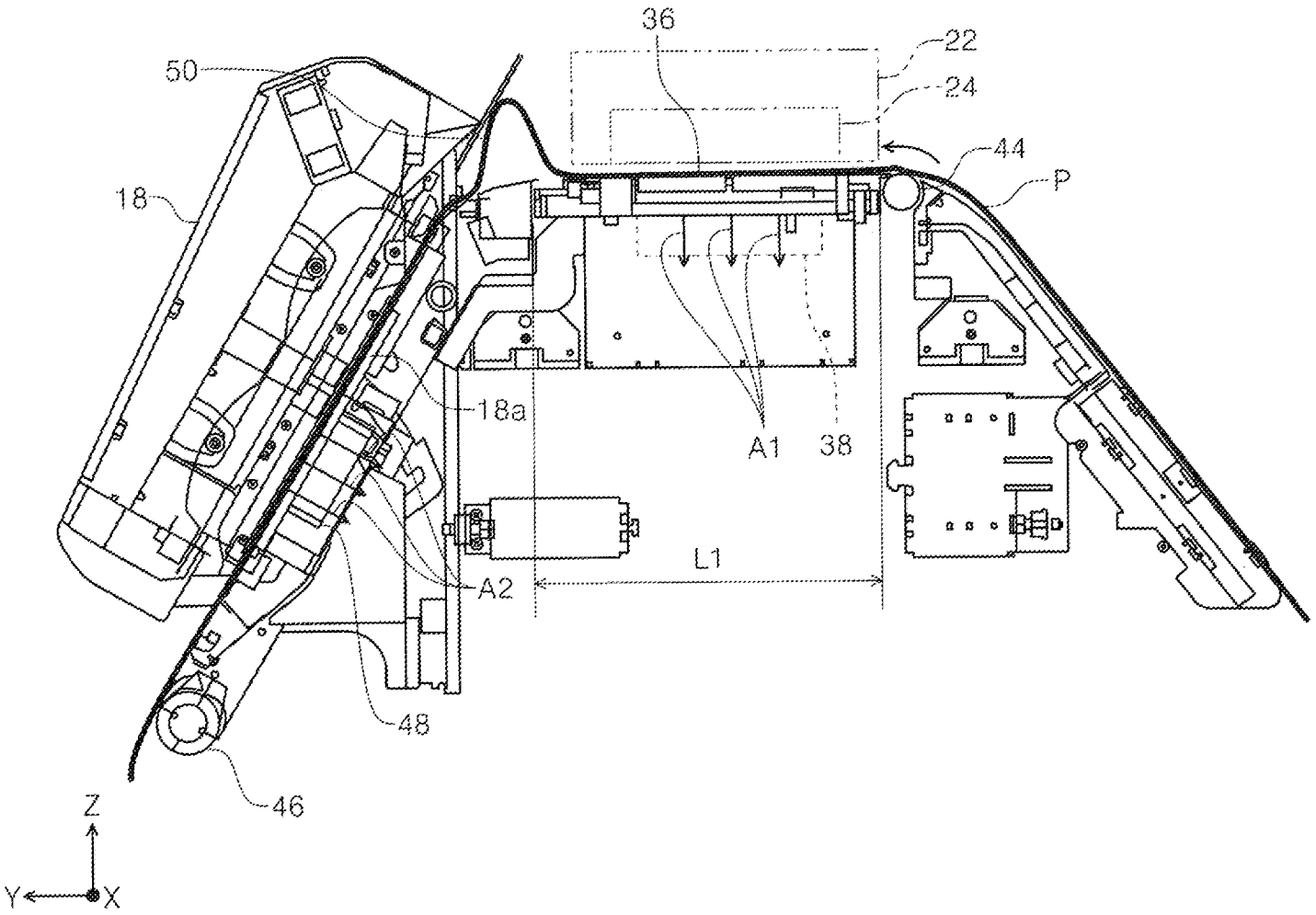
FIG. 8 is a side cross-sectional view illustrating a state where a curved portion is formed in a medium between a drying unit and the suction platen in the medium transport path of the printer.
Figure 9:
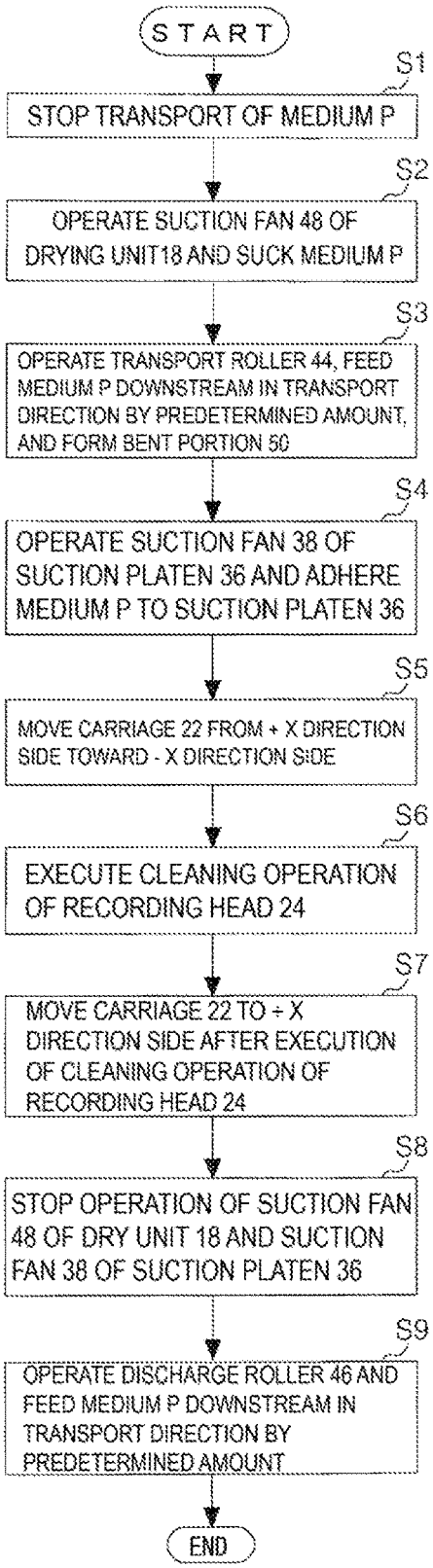
FIG. 9 is a flowchart during the maintenance operation in the printer.

FIG. 8 is a side cross-sectional view illustrating a state where a curved portion is formed in a medium between a drying unit and the suction platen in the medium transport path of the printer. FIG. 9 is a flowchart during the maintenance operation in the printer.

In an X-Y-Z coordinate system illustrated in each drawing, an X direction indicates both a device width direction and a medium width direction, a Y direction indicates the medium transport direction at a recording position, at which the medium is recorded, in a recording device, and a Z direction indicates a device height direction. Note that, in each drawing, the +X direction side is one side, the −X direction side is the other side, the +Y direction side is a device front side, and the −Y direction side is a device rear side.

Exemplary Embodiment

Overview of Recording Device

In FIG. 1, an ink jet printer 10 (hereinafter a printer 10) is described as one example of a recording device. The ink jet printer 10 includes a main body unit 12 and a pair of leg portions 14. The pair of leg portions 14 are provided on a lower portion of the main body unit 12 with some intervals between the pair of leg portions 14 in the X-axis direction. The leg portions 14 extend downward from the lower portion of the main body unit 12. Rollers 16 are provided on a lower portion of each of the leg portions 14.

The rollers 16 are rotatably provided on the leg portions 14. In the exemplary embodiment, the rotation of the rollers 16 with respect to an installation surface can facilitate the movement of the ink jet printer 10.

In the exemplary embodiment, the main body unit 12 is formed into a rectangular parallelepiped as one example, and a drying unit 18 is provided on the front side of the main body unit 12. With reference to FIGS. 2 and 6, a main frame 20 extending in the X-axis direction is provided in an upper portion of the main body unit 12. A carriage 22 is attached to the front side of the main frame 20. The carriage 22 is configured to be movable back and forth in the X-axis direction along the main frame 20. The X-axis direction intersect the transport direction. A recording head 24 (FIGS. 2, 6, and the like) is disposed in a lower portion of the carriage 22.

Note that, in the exemplary embodiment, a movement region of the carriage 22 is a region between a state (position of the carriage provided with a reference sign 22) where the carriage 22 is located on a +X direction side-end portion of the main frame 20 and a state (position of the carriage provided with a reference sign 22-1) where the carriage 22 is located on a −X direction side-end portion of the main frame 20.

The recording head 24 includes a plurality of nozzles (not illustrated) capable of discharging ink as "liquid" downward, as one example. Specifically, a lower surface of the recording head 24 is formed as a nozzle surface including the plurality of nozzles.

The +X direction side-end portion (one side) of the main body unit 12 in FIGS. 2 and 3 is a home position of the carriage 22 as one example. A cap 26 is provided in the home position (on the +X direction side-end portion) in the main body unit 12. The cap 26 is configured to cover the nozzle surface of the recording head 24 while the recording head 24 is located in the home position.

A maintenance mechanism 28 performing maintenance on the recording head 24 is provided on the −X direction side-end portion (on the other side) of the main body unit 12 in FIGS. 2, 4, and 5. In the exemplary embodiment, the maintenance mechanism 28 includes a flushing receiving portion 30, a waste liquid receiving portion 32, and a wiper 34. The flushing receiving portion 30 faces the recording head 24 while the carriage 22 is located in a flushing position (position in FIG. 5). In this state, at least a part of the recording head 24 is located above a suction platen 36. The flushing receiving portion 30 receives the ink discharged from the recording head 24 when a flushing operation is executed during execution of a recording operation. When the recording head 24 executes the flushing operation and discharges the ink downward, the flushing receiving portion 30 is configured to absorb the discharged ink. In the exemplary embodiment, an ink absorbing body as one example is disposed in the flushing receiving portion 30.

Further, the waste liquid receiving portion 32 and the wiper 34 are provided on the outside (−X-axis direction side) of the flushing receiving portion 30 in the X-axis direction. The waste liquid receiving portion 32 includes an ink absorbing body disposed inside the waste liquid receiving portion 32, and is configured to be able to absorb the ink discharged from the recording head 24. The wiper 34 is configured as a cloth material as one example and configured to be movable in the Y-axis direction. The wiper 34 is configured to be able to wipe the lower surface, namely, the nozzle surface of the recording head 24 while the recording head 24 is in a state (not illustrated) of being located in a position facing the waste liquid receiving portion 32.

Next, with reference to FIG. 2 or 4, the flat suction platen 36 extending in the X-axis direction is provided between the cap 26 and the flushing receiving portion 30 in the X-axis direction. A plurality of ribs, which are not illustrated, extending in the Y-axis direction are provided at appropriate intervals in the X-axis direction on an upper surface of the suction platen 36. A plurality of through holes (not illustrated) penetrating the suction platen 36 in the Z-axis direction are formed between the plurality of ribs.

A suction fan 38 (FIG. 6 or 8) is disposed below the suction platen 36. When the suction fan 38 is driven, gas above the suction platen 36 is sucked via the through holes (not illustrated) of the suction platen 36. This forms a flow of the gas from above to below the suction platen 36 as indicated by arrows A1 in FIG. 8. As a result, while a medium P (see a thick line provided with a reference sign P in FIGS. 6 and 8) is located on the suction platen 36, the medium P is sucked by the suction platen 36 and pressed against the upper surface of the suction platen 36.

With Regard to Medium Transport Path

Next, a transport path of the medium P in the printer 10 is described with reference to FIGS. 6 and 8. As illustrated in FIG. 6, a paper feeding unit 40 is provided on the rear side (−Y-axis direction side) of the printer 10, and a paper discharging unit 42 is provided below the drying unit 18 on the front side (+Y-axis direction side). A configuration of the paper feeding unit 40 and the paper discharging unit 42 is described in FIG. 2 by taking the paper feeding unit 42 as an example. Note that, the paper feeding unit 40 and the paper discharging unit 42 are omitted from FIG. 1. The thick line provided with the reference sign P in FIGS. 6 and 8 represents the medium P.

The paper discharging unit 42 includes a pair of bearing portions 42*a* and a spindle 42*b* (FIG. 6). The pair of bearing portions 42*a* are configured to be movable in the X-axis direction being a direction in which the bearing portions 42*a* come in contact with or separate from each other. The spindle 42*b* is inserted in an internal circumferential portion of a paper discharge roll R1. Both end portions of the spindle 42*b* are supported by the pair of bearing portions 42*a*. The bearing portions 42*a* are supplied with a drive force from a drive source (not illustrated) as one example and can thus wind the paper discharge roll R1 supported by the spindle 42*b*, that is, the bearing portions 42*a* are configured to be applied with a front tension.

Similarly, the paper feeding unit 40 also includes a pair of bearing portions 40*a* movable in the X-axis direction and a spindle 40*b* (FIG. 6). The spindle 40*b* is inserted in an internal circumferential portion of a paper feed roll R2. Both end portions of the spindle 40*b* are supported by the pair of bearing portions 40*a*. The bearing portions 40*a* are supplied with a drive force from a drive source (not illustrated) as one example and can thus feed the paper feed roll R2 supported by the spindle 40*b* downstream in the transport direction. Herein, the bearing portions 40*a* control drawing of the medium P in such a way that a back tension is applied to the medium P drawn from the paper feed roll R2.

As illustrated in FIG. 6, the medium P is configured to be drawn from the paper feed roll R2 of the paper feeding unit 40 and wound around the paper discharge roll R1 of the paper discharging unit 42 via the suction platen 36 and the drying unit 18 in the exemplary embodiment.

A transport roller 44 as a "transport mechanism" is provided upstream from the suction platen 36 in the transport direction of the medium P. The transport roller 44 is configured as a driving roller driven by a drive source, which is not illustrated. The transport roller 44 is configured to be rotatable in a normal rotation direction and a reverse rotation direction as one example. In the exemplary embodiment, the normal rotation direction is a direction in which the medium P wound around the paper feed roll R2 is drawn and transported downstream in the medium transport direction, and the reverse rotation direction is a direction in which the medium P is transported upstream from downstream in the transport direction.

A discharge roller 46 as a "discharge mechanism" is provided downstream from the drying unit 18. The discharge roller 46 is configured as a driving roller driven by a drive source, which is not illustrated.

The drying unit 18 includes a heater (not illustrated) as a heating source. The heater (not illustrated) applies heat to the medium P located in the drying unit 18, evaporates water of the ink absorbed by the medium P, and accelerates drying. A suction fan 48 as a "medium suction mechanism" is provided in the drying unit 18. The suction fan 48 extends along the transport path of the medium P in the drying unit 18, and is attached to the lower surface side of a path formation member 18*a* constituting a part of the transport path.

In the exemplary embodiment, a plurality of through holes (not illustrated) are formed in the path formation member 18*a*, and gas above the path formation member 18*a* is sucked via the through holes (not illustrated) when the suction fan 48 is driven. This forms a flow of the gas from above to below the path formation member 18*a* as indicated by arrows A2 in FIG. 8. As a result, while the medium P (see the thick line provided with the reference sign P in FIGS. 6 and 8) is located on the path formation member 18*a* of the drying unit 18, the medium P is sucked by the path formation member 18*a* and pressed against an upper surface of the path formation member 18*a*.

Note that, a controller 45 (FIG. 1) is provided in the printer 10 in the exemplary embodiment. Note that, the position in which the controller 45 is provided in the main body unit 12 in FIG. 1 is one example, and the controller 45 may be disposed in the main body unit 12 as appropriate. The controller 45 controls operations of the carriage 22, the recording head 24, the transport roller 44, and the discharge roller 46, operations of the suction fan 38 in the suction platen 36, and operations of the heater and the suction fan 48 of the drying unit 18.

With Regard to Transport Control of Medium P

Transport control of the medium P in the exemplary embodiment is described. When recording is executed on the medium P as illustrated in FIG. 7, the transport roller 44 is rotated and driven, the medium P is drawn from the paper feed roll R2, and the medium P is fed toward the suction platen 36 provided in the region facing the recording head 24. The medium P on which recording is executed by the recording head 24 passes through the drying unit 18 and is wound into the paper discharge roll R1 by the discharge roller 46.

At this time, in the drying unit 18, the heater (not illustrated) applies heat to the medium P passing through the drying unit 18 and accelerates drying of the medium P. The medium P passing through the drying unit 18 has absorbed a large amount of ink discharged from the recording head 24 and has swollen. The medium P shrinks and a dry wrinkle is generated due to the ink being dried rapidly. When transport of the medium P continues, a portion of the medium P in which the dry wrinkle is generated is successively fed downstream in the transport direction, and thus an influence of the dry wrinkle to the recording head 24 and the suction platen 36 can be reduced while the dry wrinkle does not grow toward the suction platen 36 side.

For a long continuous medium P in the longitudinal direction, such as a roll paper, transport of the medium P may be temporally stopped. For example, it is when the recording operation of one job is completed in the medium P, and the maintenance operation is executed in the recording head 24 before execution of a next job. Specifically, it is when clogging of the nozzles is ascertained after a nozzle check, when a loss of ink occurring in the nozzles during the recording operation is ascertained, or when the recording operation is executed for a predetermined period. Note that, the ascertaining operation may be executed by the controller 45 or a user. When these phenomena occur, the controller 45 temporarily stops the transport of the medium P, and moves the recording head 24 (carriage 22) from the home position or above the suction platen 36 toward the maintenance mechanism 28 located on the −X-axis direction side with respect to the suction platen 36.

At this time, when the transport of the medium P stops, heating time for a part of the medium P, specifically, a portion heated in the drying unit 18 is increased further than that when the medium P is being transported. As a result, the dry wrinkle becomes larger because drying of the medium P proceeds more than a predetermined level and shrinking of the medium P proceeds. In this way, the dry wrinkle generated in the medium P grows upstream in the medium transport direction, that is, extends upstream in the transport direction.

As a result, the dry wrinkle of the medium P may reach the suction platen 36 in the medium transport direction. The dry wrinkle reaching the suction platen 36 cannot be pressed against the suction platen 36 even by a suction force of the suction fan 38, and thus the medium P undulates along the X-axis direction on the suction platen 36. In this state, when the carriage 22 crosses the suction platen 36, the undulating portion of the medium P comes in contact with the recording head 24, and thus rubs against the head.

In the printer 10 in the exemplary embodiment, a curved portion 50 (FIG. 8) being curved upward as one example is formed in the medium P between the suction platen 36 and the drying unit 18 in the medium transport direction. By forming the curved portion 50 in the medium P between the suction platen 36 and the drying unit 18, when a dry wrinkle generated in the drying unit 18 extends upstream in the transport direction and reaches the curved portion 50, the dry wrinkle can be prevented from extending upstream from the curved portion 50 in the transport direction.

A method for forming the curved portion 50 during the execution of the maintenance operation of the recording head 24 will be described with reference to FIG. 8 as appropriate along with the flow of the flowchart in FIG. 9. In Step S1 (FIG. 9, also see FIG. 9 for the following steps), the controller 45 temporarily stops the transport of the medium P. Next, in Step S2, the suction fan 48 of the drying unit 18 is driven, and a part of the medium P located in the drying unit 18 is sucked toward the path formation member 18*a* side as indicated by the arrows A2 (FIG. 8). In this way, the medium P located in the drying unit 18 is pressed against the path formation member 18*a*, and restricted from moving in the medium transport direction.

Next, in Step S3, the transport roller 44 is rotated and driven in the normal rotation direction, and the medium P is fed downstream in the transport direction by a predetermined amount, while the medium P is sucked by driving the suction fan 48. Herein, the predetermined amount in the exemplary embodiment is a width L1 (FIG. 8) of the suction platen 36 in the medium transport direction by which the medium P is fed as one example. Herein, since the portion of the medium P located in the drying unit 18 is restricted from moving in the transport direction, when the medium P is fed fom the suction platen 36, the curved portion 50 is formed by curving the medium P upward before the drying unit 18, namely, between the drying unit 18 and the suction platen 36. In the exemplary embodiment, the medium P is fed downstream in the transport direction by a predetermined amount (width L1), and the curved portion 50 is formed, so that the curved portion 50 having a sufficient size for preventing a dry wrinkle from extending upstream in the transport direction can be formed.

In Step S4, the controller 45 drives the suction fan 38 of the suction platen 36, and a portion of the medium P facing the suction platen 36 is sucked toward the suction platen 36 (arrows A1 in FIG. 8) after the Step S3. In this way, the portion of the medium P facing the suction platen 36 is also restricted from moving in the medium transport direction, and thus the curved portion 50 can maintain its shape. Note that, the controller 45 starts driving of the suction fan 38, and, at the same time, stops rotation and driving of the transport roller 44 as one example.

Next, the carriage 22 (the recording head 24) is caused to move from the +X direction side toward the −X direction side and cross above the suction platen 36 as in Step S5. In this state, the portion of the medium P facing the suction platen 36 is prevented from growing a dry wrinkle by the curved portion 50 and is also sucked to the upper surface of the suction platen 36, and is thus pressed against the upper surface of the suction platen 36. In this way, when the carriage 22 crosses above the suction platen 36, contact between the recording head 24 and the portion of the medium P facing the suction platen 36 can be suppressed.

As in Step S6, the controller 45 operates the maintenance mechanism 28 (the flushing receiving portion 30, the waste liquid receiving portion 32, and the wiper 34), and executes the maintenance operation on the recording head 24 after the Step S5. As in Step S7, after the execution of the maintenance operation, the carriage 22 (the recording head 24) is caused to move to the +X direction side, for example, the home position and the like.

The controller 45 starts to eliminate the curved portion 50 during Step S8 and Step S9. As in the Step S8, driving of the suction fan 38 of the suction platen 36 and the suction fan 48 of the drying unit 18 is stopped. This releases the restriction of the movement in the medium transport direction of the portion of the medium P in the drying unit 18 and the portion of the medium P facing the suction platen 36 that have been restricted from moving in the transport direction.

In Step S9, the discharge roller 46 is rotated in the direction in which the medium P is fed downstream in the transport direction, and the medium P is fed downstream in the transport direction by the width L1 (FIG. 8) of the suction platen 36 in the medium transport direction. Thus, the curved portion 50 formed between the suction platen 36 and the drying unit 18 is eliminated.

Contact between the medium P on the suction platen 36 and the recording head 24 can be suppressed by forming the curved portion 50. Thus, smudging of the portion of the medium P facing the suction platen 36 due to contact with the recording head 24 can be suppressed. As a result, the recording operation can restart from the portion of the medium P facing the suction platen 36 only by eliminating the curved portion 50 from the long medium P. Thus, a portion of the medium P without execution of recording between the portion on which recording has already been executed (the portion located in the drying unit 18) and a portion on which recording is to be newly executed can be reduced in length, so that waste paper in the medium P can be reduced.

In the exemplary embodiment, an influence of a dry wrinkle generated in the portion of the medium P located in the drying unit 18 on the suction platen 36 can be suppressed by forming the curved portion 50 in the medium P between the suction platen 36 and the drying unit 18. As a result, contact between the recording head 24 crossing above the suction platen 36 and the portion of the medium P facing the suction platen 36 can be suppressed, and occurrence of rubbing by the head can be suppressed.

Modification of Exemplary Embodiment

In the exemplary embodiment, the medium P is fed by the width L1 of the suction platen 36 in the medium transport direction as a predetermined amount in order to form the curved portion 50 of the medium P. Instead of this configuration, for example, the medium P may be fed by a half-length of the width L1 of the suction platen 36. The predetermined amount may be a feeding amount needed to form the curved portion 50 having the size for preventing growth of a dry wrinkle between the suction platen 36 and the drying unit 18. Further, the predetermined amount may be set according to a kind of a medium.

In the exemplary embodiment, in Step S9 in FIG. 9, the controller 45 controls the discharge roller 46 to feed the medium P is fed downstream in the transport direction by L1 for eliminating the curved portion 50. Instead of this configuration, the curved portion 50 may be eliminated by winding the medium P upstream in the transport direction by L1 by rotating the transport roller 44 in the reverse rotation direction, after sucing by the suction platen has been stopped. With such a configuration, a distance between portions of the medium P on which recording are executed can be shortened, and a waste paper portion of the medium P can be reduced.

The medium P in the exemplary embodiment is roll paper as one example. Instead of this configuration, the medium P may be a cut sheet.

In the exemplary embodiment, the home position is provided on the +X-axis direction side, and the maintenance mechanism 28 is provided on the −X-axis direction side. Instead of this configuration, the home position may be provided on the −X-axis direction side, and the maintenance mechanism 28 may be provided on the +X-axis direction side.

In the exemplary embodiment, the curved portion 50 is formed in the medium P during the execution of the maintenance operation of the recording head 24. In addition to this configuration, the curved portion 50 may also be formed during the execution of the recording operation of the recording head 24. In this configuration, the curved portion 50 can be formed in the medium P by adjusting at least one of a feeding speed of the transport roller 44 and the discharge roller 46. Specifically, the curved portion 50 can be formed by, for example, increasing a feeding speed of the transport roller 44 more than a feeding speed of the discharge roller 46. Furthermore, the size of the curved portion 50 to be formed can be adjusted as appropriate by adjusting a feeding speed of the transport roller 44 and the discharge roller 46. As a result, the curved portion 50 having the appropriate size according to a kind of the medium P is formed, and thus growth of a dry wrinkle extending from the drying unit 18 (a dry wrinkle extending upstream in the transport direction) can be more reliably prevented by the curved portion 50.

In the exemplary embodiment, as one example, the curved portion 50 is formed as follows. While the suction fan 48 of the drying unit 18 is driven and the medium P located in the drying unit 18 is pressed against the path formation member 18*a*, the transport roller 44 is rotated and driven in the normal rotation direction, and the medium P is fed downstream in the transport direction by a predetermined amount. Subsequently, the suction fan 38 of the suction platen 36 is driven, and a portion of the medium P facing the suction platen 36 is sucked toward the suction platen 36. Instead of this configuration, the curved portion 50 may be formed as follows. While the medium P is sucked to the suction platen 36 to a degree that movement of the medium P in the transport direction is not completely restricted by the suction platen 36, the suction fan 48 of the drying unit 18 is driven, and the medium P located in the drying unit 18 is pressed against the path formation member 18*a*. Then, the transport roller 44 is rotated and driven in the normal rotation direction, and the medium P is fed downstream in the transport direction by a predetermined amount.

Further, the method for forming the curved portion 50 is applied to an ink jet printer as one example of a recording device in the exemplary embodiment, but is also applicable to other general liquid injection devices.

Herein, the liquid injection device is not limited to recording devices such as printers, copying machines, and facsimile machines that use an ink jet-type recording head, discharge ink from the recording head, and perform recording on a recorded medium. The liquid injection device includes a device that injects liquid for use of ink instead of the ink to an injected medium corresponding to a recorded medium from a liquid injection head corresponding to the ink jet-type recording head, and allows the liquid to adhere to the injected medium.

Examples of the liquid injection head include, in addition to the recording head, a color material injection head used for manufacturing a color filter of a liquid crystal display and the like, an electrode material (conductive paste) injection head used for forming an electrode of an organic EL display, a surface emitting display (FED), and the like, a biometric organic matter injection head used for manufacturing a biochip, and a sample injection head as a precision pipet.

Note that the invention is not intended to be limited to the aforementioned examples, and many variations are possible within the scope of the invention as described in the appended claims. It goes without saying that such variations also fall within the scope of the invention.

This application claims priority under 35 U.S.C. § 119 to Japanese Patent Application No. 2018-055765, filed Mar. 23 2018. The entire disclosure of Japanese Patent Application No. 2018-055765 is hereby incorporated herein by reference.

What is claimed is:

1. A recording device comprising:

a carriage including a recording head configured to discharge liquid onto a medium and being movable in an intersecting direction, the intersecting direction intersecting a transport direction of the medium;

a suction platen facing the recording head and being configured to suck the medium;

a transport mechanism provided upstream from the suction platen in the transport direction and configured to transport the medium downstream in the transport direction;

a drying unit located downstream from the recording head in the transport direction;

a medium suction mechanism configured to suck the medium fed to the drying unit; and a controller configured to control the transport mechanism to form a curved portion by curving, between the drying unit and the suction platen in the transport direction, a part of the medium, wherein the curved portion is formed by:

feeding the medium by a predetermined amount by the transport mechanism while the medium is sucked by the medium suction mechanism, and sucking the medium by the suction platen after the medium fed by the predetermined amount.

2. The recording device according to claim 1, wherein, when a maintenance operation of the recording head is executed while a part of the medium is located in the drying unit, the controller is configured to move the carriage in the intersecting direction for the maintenance operation, after the curved portion has been formed.

3. The recording device according to claim 2, further comprising:

a discharge mechanism provided downstream from the suction platen in the transport direction and configured to discharge the medium, wherein the controller, after the execution of the maintenance operation, is configured to eliminate the curved portion by:

stopping sucking the medium by the suction platen and the medium suction mechanism, and feeding the medium downstream in the transport direction by the discharge mechanism after stopping sucking.

4. The recording device according to claim 2, wherein the controller, after the maintenance operation, is configured to eliminate the curved portion by:

stopping sucking the medium by the suction platen, and feeding the medium upstream in the transport direction by the transport mechanism after stopping sucking.

5. The recording device according to claim 2, further comprising:

a maintenance mechanism configured to perform maintenance on the recording head, wherein one side of a region of movement of the carriage in the intersecting direction is a home position, and the maintenance mechanism is disposed on the other side.

6. The recording device according to claim 5, wherein the maintenance operation is executed, after the carriage have been moved from the one side to the other side in the intersecting direction.

7. The recording device according to claim 5, wherein the maintenance mechanism includes:

a waste liquid receiving portion configured to receive liquid discharged from the recording head during the maintenance operation and a wiper configured to clean a nozzle surface of the recording head.

8. The recording device according to claim 1, further comprising:

a discharge mechanism provided downstream from the suction platen in the transport direction and configured to discharge the medium, wherein the curved portion is formed by adjusting at least one of a medium feeding speed of the transport mechanism and a medium feeding speed of the discharge mechanism.

9. A recording device comprising:

a carriage including a recording head configured to discharge liquid onto a medium and being movable in an intersecting direction, the intersecting direction intersecting a transport direction of the medium;

a suction platen facing the recording head and being configured to suck the medium;

a transport mechanism provided upstream from the suction platen in the transport direction and configured to transport the medium downstream in the transport direction;

a drying unit located downstream from the recording head in the transport direction;

a medium suction mechanism configured to suck the medium fed to the drying unit; and a controller configured to control the transport mechanism to form a curved portion by curving, between the drying unit and the suction platen in the transport direction, a part of the medium, wherein the curved portion protrudes more than a curve formed on the medium when the medium is transported during recording.

* * * * *